US006135617A

United States Patent [19]

Lai

[11] Patent Number: 6,135,617

[45] Date of Patent: Oct. 24, 2000

[54] FOLDING ILLUMINATION SKELETON

[76] Inventor: Wei-Cheng Lai, 9-47 Ho Hsing, Ho Hsing Village, Hu-Kou, Hsinchu Hsien, Taiwan

[21] Appl. No.: 09/425,139

[22] Filed: Oct. 21, 1999

[51] Int. Cl.[7] ..... F21V 21/088

[52] U.S. Cl. ..... 362/249; 362/252; 362/396

[58] Field of Search ..... 362/249, 250, 362/252, 285, 289, 396, 418, 427, 806, 809

[56] References Cited

U.S. PATENT DOCUMENTS 5,629,057 5/1997 Wang et al. ..... 362/806

5,645,343 7/1997 Rinehimer ..... 362/252

5,876,111 3/1999 Wu ..... 362/250

*Primary Examiner*—Y. Quach

[57] ABSTRACT

An illumination skeleton with a foldable structure for mounting lamps includes two connecting plates, a plurality of lamp frames, and a plurality of lamp sockets. Both ends of each lamp frame are connected to the two connecting plates, respectively. Each lamp socket which is inserted with a lamp is clamped with and fixed on the lamp frames. The illumination skeleton can be folded with less space for storage and the cost of manufacturing is reduced. Furthermore, the illumination skeleton has a wide variety of versatile appearances.

7 Claims, 5 Drawing Sheets

FOLDING ILLUMINATION SKELETON

FIELD OF THE INVENTION

The present invention relates to a folding illumination skeleton, and more particularly, to a lamp skeleton having a foldable structure with less space for easy storage and a wide variety of versatile appearances.

BACKGROUND OF THE INVENTION

Stereo illumination skeletons with a fixed shape of a spherical or hexagonal lantern have been widely used in many celebrations at night to enhance the visual effect by means of the sparkling light from the lamps mounted on the illumination skeleton. The illumination skeleton is typically hollow and may contain some puppets or other suitable decorations to enhance the appearance. However, the conventional illumination skeleton with a fixed shape generally needs a larger space to store and often results in inconvenience. The cost associated with manufacturing is also higher and the illumination skeleton can not be easily modified.

Therefore, an illumination skeleton with a foldable structure has been in great demand.

SUMMARY OF THE INVENTION

An object of the present invention is to provide a folding illumination skeleton, which can be folded into a flat shape for easy storage and expanded to a spherical body or other shapes in use.

Another object of the present invention is to provide a folding, illumination skeleton having lower cost of manufacturing and much easier to produce. The illumination skeleton consists of two connecting plates, a plurality of lamp frames, and a plurality of lamp sockets. Both ends of each lamp frame are pivoted on the two connecting plates, respectively. Each lamp socket which is inserted with a lamp is clamped with and fixed on the lamp frame so that the illumination skeleton can be folded with less space for storage and the cost of manufacturing is also reduced.

A further object of the present invention is to provide a folding illumination skeleton with a wide variety of versatile appearances. The illumination skeleton can mount several Christmas lamps as desired on the lamp sockets clamped on the lamp frames. The location of the lamps are dependent on the lamp sockets along the lamp frames so as to modify the visual effect of the whole sparkling lamp series. The shape of the illumination skeleton is expanded to a shape of a sphere if each lamp frame is semicircular, or expanded to a shape of a bottle gourd if each lamp frame has double arcs. The shape of each lamp frame determines the entire shape of the folding illumination skeleton.

Another object of the present invention is to provide a folding illumination skeleton with higher safety. The illumination skeleton includes lamp sockets, each lamp socket having one end with two C shape openings to clamp on a pair of lamp frames and another end with a larger C shape opening to clamp on a lamp. The larger C shape opening forms two concave arcs at the inner edge to accommodate and tightly fix the wire so as to achieve nice looking and more safety.

A further object of the present invention is to provide a folding illumination skeleton for a wide range of applications. The illumination skeleton includes two connecting plates on two ends of the folding illumination skeleton, respectively. Each connecting plate has a penetrating hole to insert a hook device which is used to hang the folding illumination skeleton at a suitable location as desired. Various folding illumination skeletons with different shapes may be connected together to enhance the appearance of the whole set of folding illumination skeletons. The skeleton is hollow and may contain a puppet, an inflatable balloon, or any appropriate decoration to increase the value of the illumination skeleton.

Other features and advantages of the invention will become apparent from the following description of the invention, which refers to the accompanying drawings.

ETAILED DESCRIPTION OF THE PREFERRED EMBODIMENTS

Figure 1:
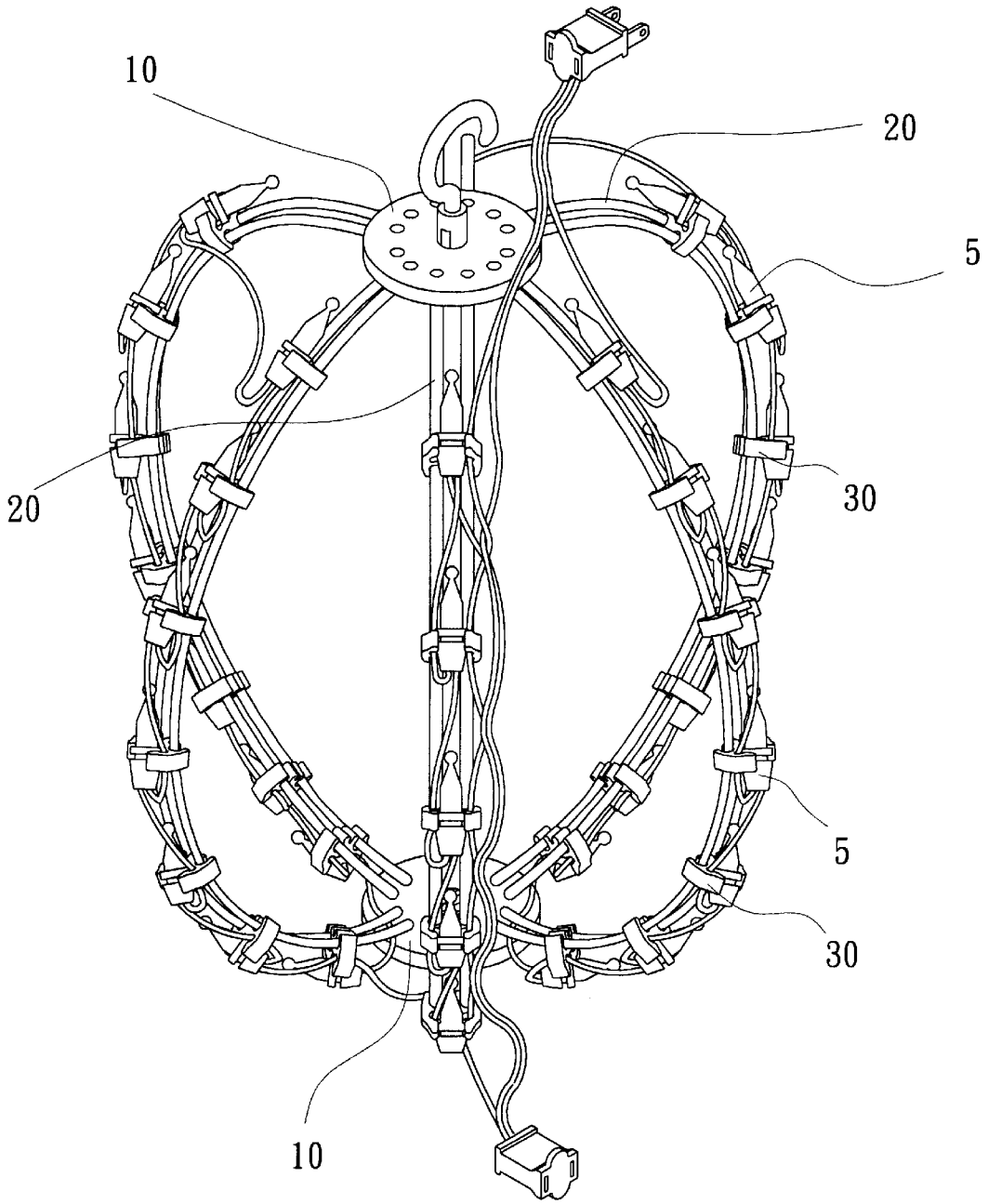
FIG. 1 is a three-dimensional view of the folding illumination skeleton according to the present invention.

With reference to FIG. 1, the illumination skeleton of the present invention includes two connecting plates 10, a plurality of lamp frames 20, and a plurality of lamp sockets 30. Both ends of each lamp frame 20 are pivoted on the two connecting plates 10, respectively. Each connecting plate 10 has a plurality of holes positioned circularly with respective to the center of the connecting plate, and each hole is used to receive one end of a respective lamp frame with several lamps 5 mounted on the lamp sockets 30. Every two lamp frames 20 are arranged as a set to connect the two connecting plates 10.

Figure 2:
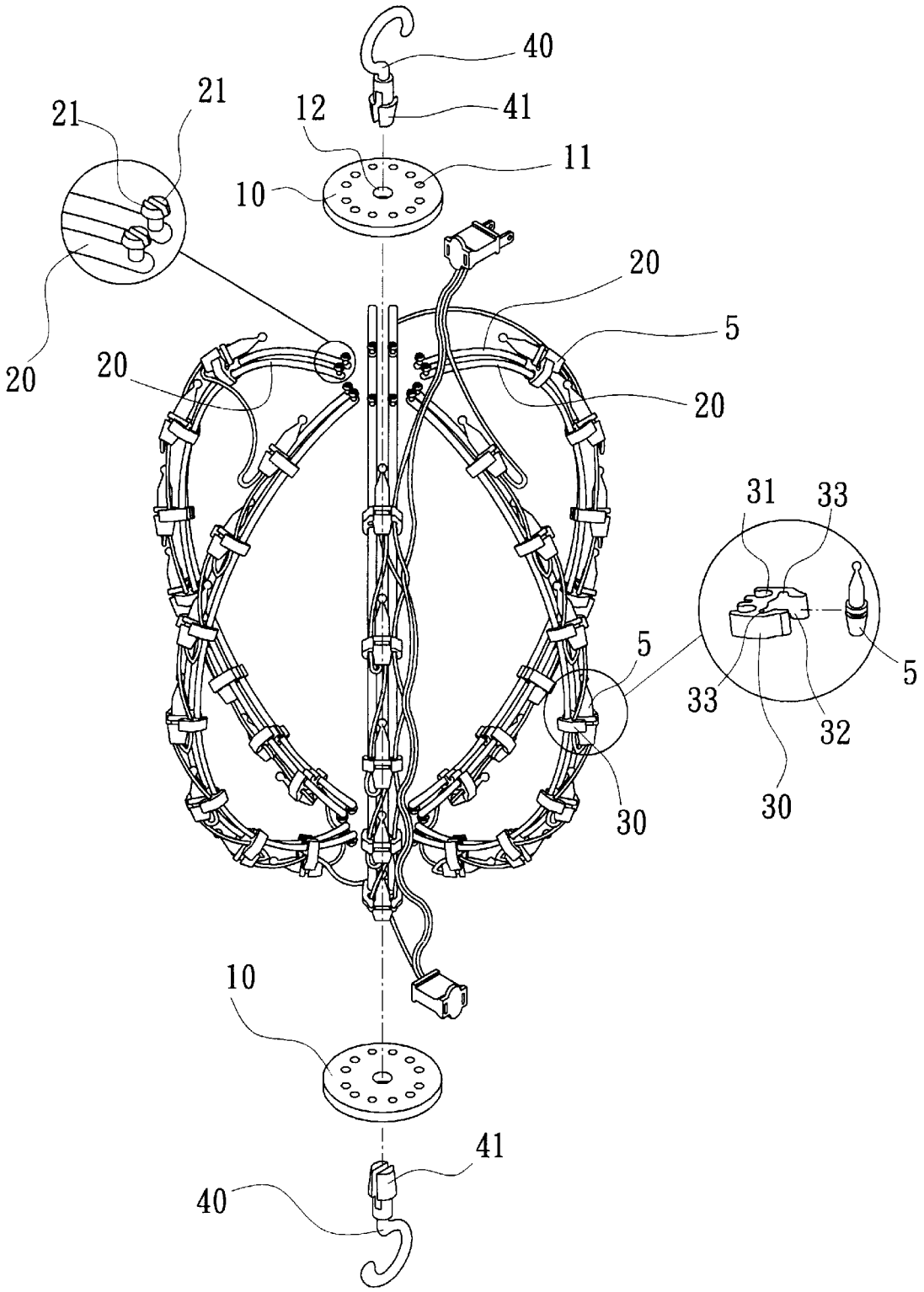
FIG. 2 shows an exploded diagram of the folding illumination skeleton according to the present invention.

With reference to FIG. 2, all the components of the folding illumination skeleton according to the present invention are illustrated in detail. The connecting plate 10 is a circular plate. A plurality of holes 11 are formed circularly around the center of the connecting plate 10 so as to connect the lamp frames 20. A penetrating hole 12 at the center is used for inserting the hook device 40. The top of the hook device 40 forms a hook and the bottom consists of two opposite semicircular convex parts 41 which are semi-cones with radius gradually increasing from one end to the other. The semicircular convex parts 41 are coupled into the penetrating hole 12 for connecting to the illumination skeleton.

Each lamp frame 20 is a curved rod with a shape of an arc. The plurality of lamp frames can be expanded as a spherical illumination skeleton with good looking. However, the shape of the lamp frame 20 described herein is not used to limit the scope of the present invention. Each lamp frame 20 may have a shape of double arcs to collectively form an illumination skeleton with a shape of a pumpkin when expanded, or have a triangular shape. Each of the two ends of the lamp frame 20 comprises two semicircular convex parts 21 to be received in a hole 11 to rotatively adjust the location of the lamp frame 20.

In the embodiment, a pair of lamp frames form a group. The lamp sockets 30 are clamped on the lamp frame 20. Each lamp socket 30 has one end with two C shape openings 31 to clamp the lamp frame 20 and another end with a larger C shape opening 32 to clamp a lamp 5. The larger C shape opening 32 forms two concave recesses 33 to accommodate and tightly fix the wire so as to achieve nice looking and better safety.

Figure 3:
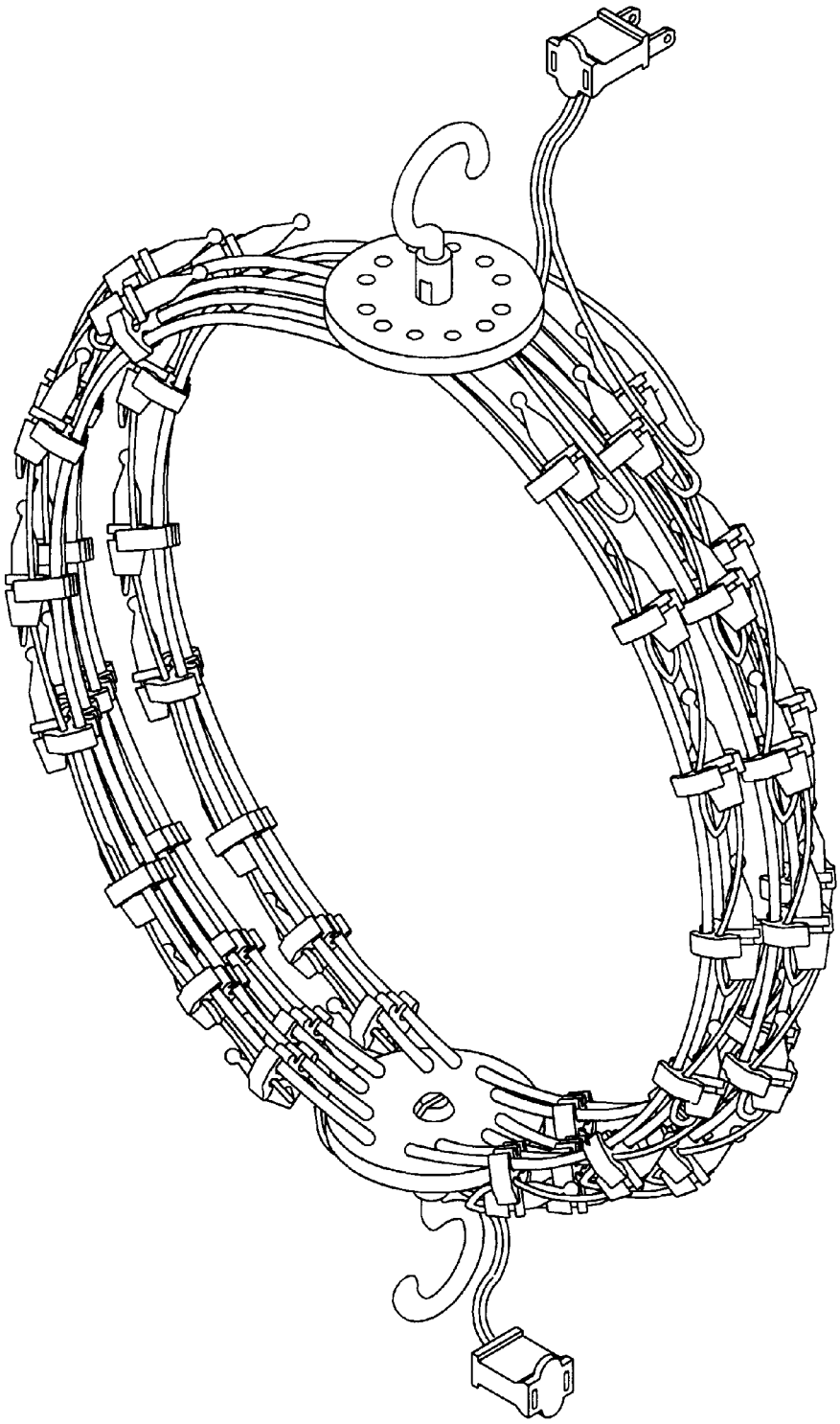
FIG. 3 is a three-dimensional view of the folding illumination skeleton when folded.

With reference to FIG. 3, the folding illumination skeleton of the present invention is folded as a flat shape for easy sotrage and reducing the space required.

Figure 4:
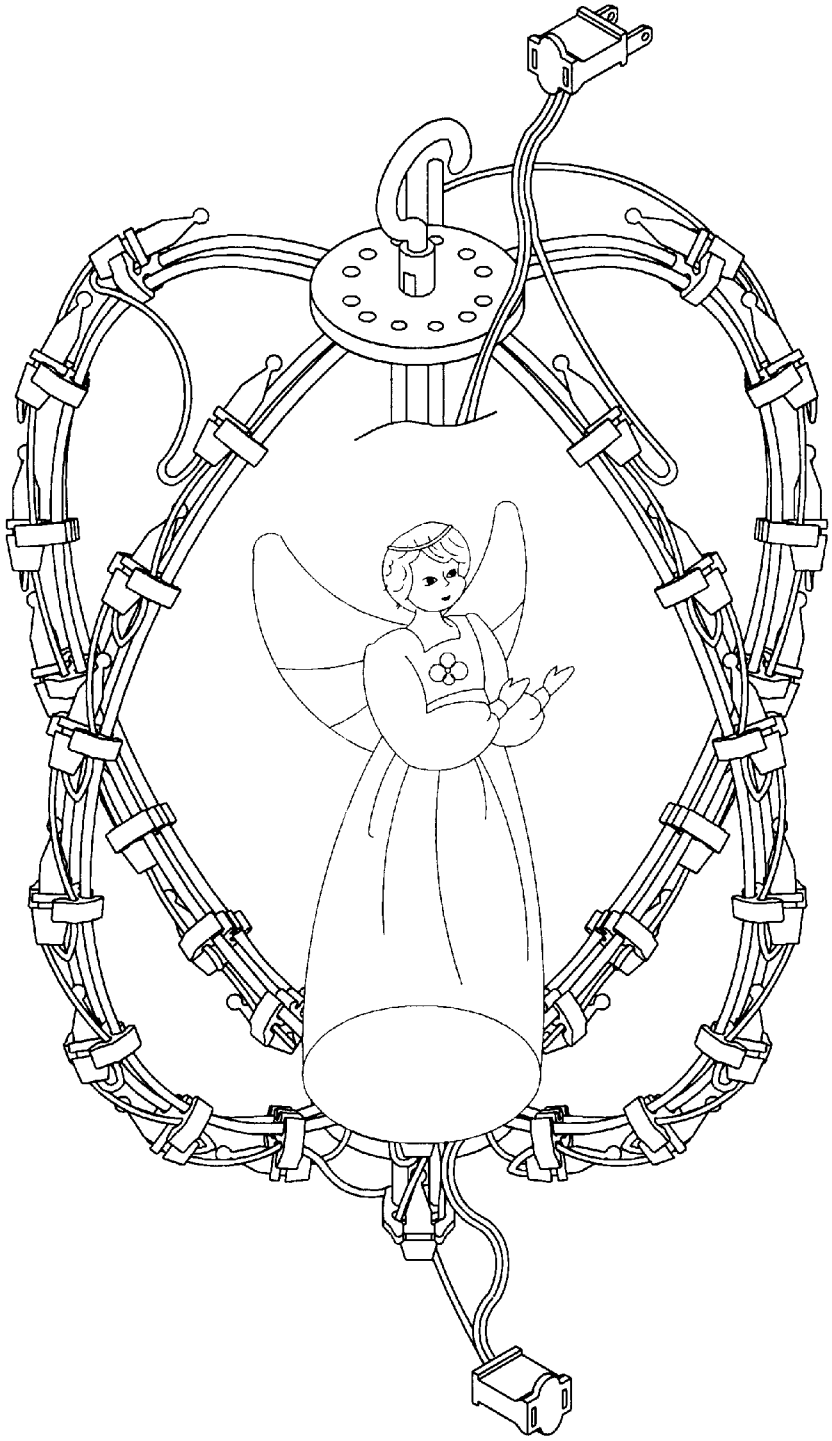
FIG. 4 shows a three-dimensional view of the folding illumination skeleton with a puppet.

With reference to FIG. 4, a puppet as an example of decoration can be placed within the illumination skeleton of the present invention because the skeleton is hollow.

Figure 5:
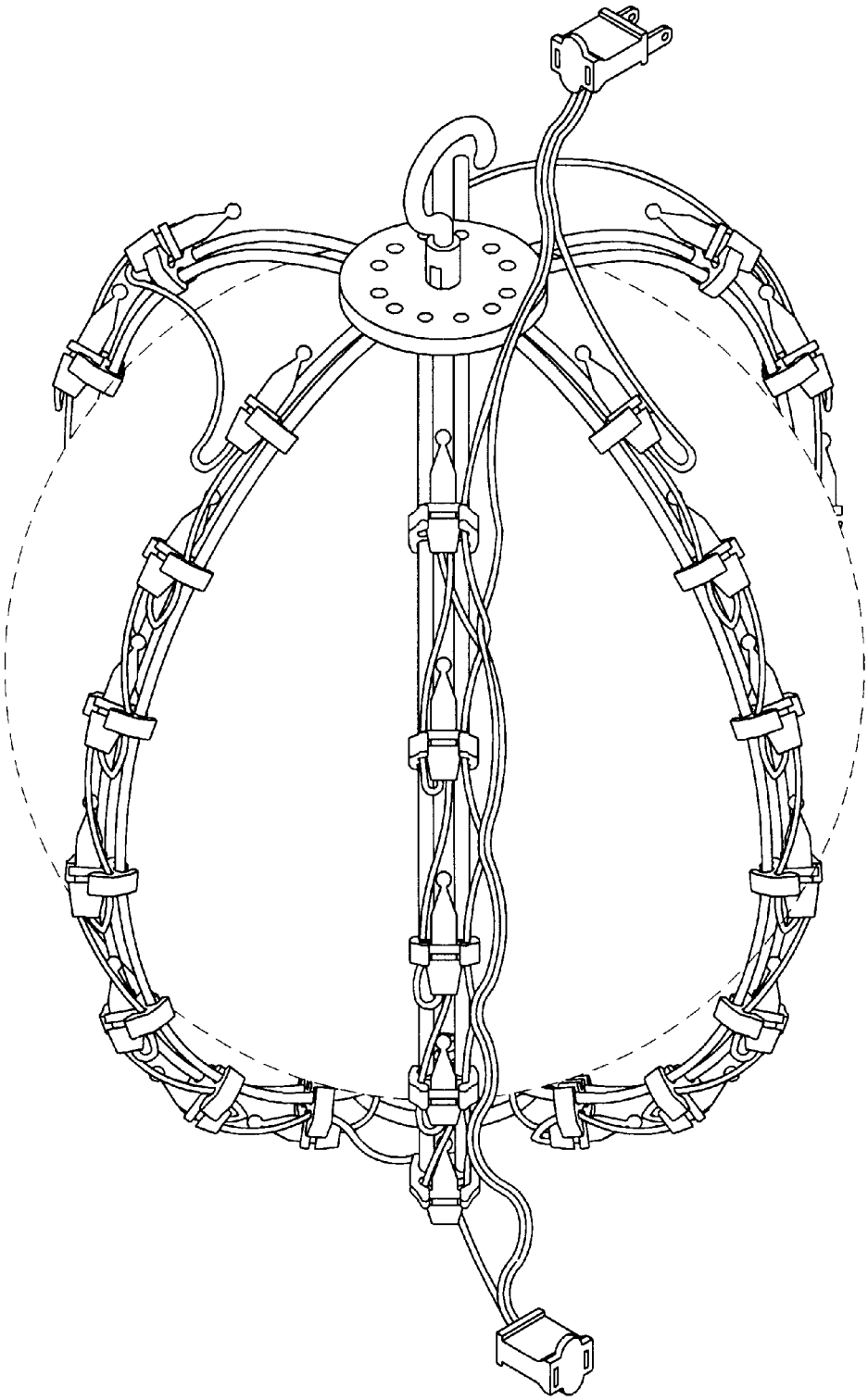
FIG. 5 shows a three-dimensional view of the folding illumination skeleton with an inflatable balloon.

With reference to FIG. 5, an inflatable balloon as another example of decoration placed within the illumination skeleton of the present invention is shown. The inflatable balloon such as a beach ball may have some print or pattern on the surface. Other applications for the inflatable balloon are an All Saint's Day lamp with a shape of a pumpkin, an advertisement air ball printed with bright colors and touching words, and so forth.

Although only the preferred embodiments of this invention were shown and described in the above description, it is requested that any modification or combination that come within the spirit of this invention be protected.

What is claimed is:

1. A folding illumination skeleton, comprising:

two connecting plates, each connecting plate having a center and a plurality of holes positioned circularly with respect to said center;

a plurality of lamp frames each having two ends received in two corresponding holes on said two connecting plates, each of said two ends comprising two semicircular convex parts received in a hole on a connecting plate;

a plurality of lamp sockets mounted on said plurality of lamp frames; and a plurality of lamps clamped on said plurality of lamp sockets.

2. The folding illumination skeleton according to claim 1, each connecting plate further having a center hole for accommodating a hook device.

3. The folding illumination skeleton according to claim 2, wherein every two lamp frames are arranged as a set.

4. The folding illumination skeleton according to claim 3, wherein each lamp socket has a first end with two C shape openings for clamping on and fixing two lamp frames together, and a second end with a larger C shape opening for clamping on a lamp.

5. The folding illumination skeleton according to claim 4, wherein the larger C shape opening of said second end further has two concave recesses for accommodating wires.

6. A folding illumination skeleton, comprising:

two connecting plates, each connecting plate having a center and a plurality of holes positioned circularly with respect to said center;

a plurality of lamp frames each having two ends received in two corresponding holes on said two connecting plates;

a plurality of lamp sockets mounted on said plurality of lamp frames, each lamp socket having a first end with two C shape openings for clamping on and fixing two lamp frames together, and a second end with a larger C shape opening for clamping on a lamp, said larger C shape opening having two concave recesses for accommodating wires; and a plurality of lamps being clamped on said plurality of lamp sockets.

7. The folding illumination skeleton according to claim 6, each connecting plate further having a center hole for accommodating a hook device.

* * * * *